US007688051B1

(12) United States Patent
Li et al.

(10) Patent No.: US 7,688,051 B1
(45) Date of Patent: Mar. 30, 2010

(54) LINEAR REGULATOR WITH IMPROVED POWER SUPPLY REJECTION

(75) Inventors: Kan Li, Singapore (SG); Kee Hian Tan, New Tech Park (SG)

(73) Assignee: Marvell International Ltd., Hamilton (BM)

( * ) Notice: Subject to any disclaimer, the term of this patent is extended or adjusted under 35 U.S.C. 154(b) by 233 days.

(21) Appl. No.: 11/881,457

(22) Filed: Jul. 27, 2007

Related U.S. Application Data

(60) Provisional application No. 60/822,152, filed on Aug. 11, 2006.

(51) Int. Cl.
*G05F 1/00* (2006.01)

(52) U.S. Cl. ..... 323/280; 323/316

(58) Field of Classification Search ..... 323/282–288, 323/312–316, 265, 271, 273, 280, 207; 327/65, 327/427, 535, 538, 540–545, 393
See application file for complete search history.

(56) References Cited

U.S. PATENT DOCUMENTS 5,357,149 A * 10/1994 Kimura ..... 327/512
7,446,514 B1 * 11/2008 Li et al. ..... 323/280

* cited by examiner

*Primary Examiner*—Rajnikant B Patel

(57) ABSTRACT

A linear regulator for outputting a regulated voltage with improved rejection of high frequency components in the power supply. The linear regulator includes an op-amp connected in a linear feedback loop to drive first and second current legs based on a voltage reference. An output driver includes a load capacitance across which the regulated voltage is output, and further includes a ratio-driven current mirror having a mirror ratio defined by relative sizes of active devices in the first and second current legs, as compared with relative sizes of active devices in the output driver. Because the output driver and its load capacitance are provided outside the linear feedback loop, large values for the load capacitance can be selected without destabilization of the feedback loop. Thus, the value of the load capacitance can be chosen at any value according to frequency rejection requirements.

18 Claims, 5 Drawing Sheets

LINEAR REGULATOR WITH IMPROVED POWER SUPPLY REJECTION

CROSS-REFERENCE TO RELATED APPLICATION

This application claims the benefit of U.S. Provisional Patent Application No. 60/822,152, filed Aug. 11, 2006, the contents of which are hereby incorporated by reference as if fully stated herein.

FIELD OF THE INVENTION

The present invention relates to a linear regulator for providing a regulated voltage, and particularly to such a linear regulator with improved rejection of high frequency components of the power supply.

BACKGROUND OF THE INVENTION

Linear regulators are widely deployed for providing a regulated output voltage based on an inputted reference voltage, such as a reference voltage that might be provided by a bandgap reference. A simplified example of a conventional linear regulator is depicted in FIG. 1.

As shown in FIG. 1, linear regulator 10 includes op-amp 1 connected in a linear feedback loop based on voltage reference Vref. Op-amp 1 drives the gate of NMOS transistor 2, which is connected in series with a resistor-capacitor network of load resistor 3 (RL) and load capacitor 4 (CL). Because of the linear feedback loop in which op-amp 1 is connected, output voltage 5 is equal to the reference voltage, i.e., Vo=Vref.

The FIG. 1 linear regulator 10 effectively attenuates low frequencies in the power supply, and at low frequencies the relationship of Vo=Vref is accurate. However, for higher frequencies in the power supply, the effect of parasitic capacitance becomes more pronounced. Specifically, the parasitic capacitance Cds between source and drain of NMOS transistor 2 affects the ability of the linear regulator 10 to reject high frequencies in the power supply. In particular, at high frequencies, the ability of linear regulator 10 to achieve high power supply rejection is determined by the ratio of Cds to CL.

As a consequence, for good power supply rejection at high frequencies, it is preferable that CL be as large as possible. However, large values for CL are not easy to fabricate, and in addition large values of CL tend to destabilize the linear feedback loop.

Thus, conventional linear regulators suffer from an inability to achieve good rejection of high frequency components of the power supply.

SUMMARY OF THE INVENTION

The present invention addresses the foregoing disadvantages in prior art linear regulators, and provides a linear regulator with good rejection of high frequency components of the power supply. Specifically, the present invention includes a linear regulator in which an output driver for providing the regulated voltage is arranged outside of the linear feedback loop.

In one aspect, the invention is a linear regulator which outputs a regulated voltage, and includes an op-amp connected in a linear feedback loop to drive first and second current legs based on a voltage reference, wherein each of the first and second current legs has active components with an identical first size. An output driver includes a load capacitance across which the regulated voltage is output. The output driver includes a ratio-driven current mirror having active components with a second size, wherein the current mirror is driven to mirror current in the first and second legs at a ratio of the first size to the second size.

By virtue of the foregoing arrangement, since the output driver is provided outside the linear feedback loop of the op-amp, its value does not affect stability of the linear feedback loop. As a consequence, the load capacitance can be made as large as desired, in correspondence to the desired frequency rejection requirement.

This brief summary has been provided so that the nature of the invention may be understood quickly. A more complete understanding of the invention can be obtained by reference to the following detailed description of the preferred embodiment thereof in connection with the attached drawings.

DETAILED DESCRIPTION OF THE PREFERRED EMBODIMENT

Figure 2:
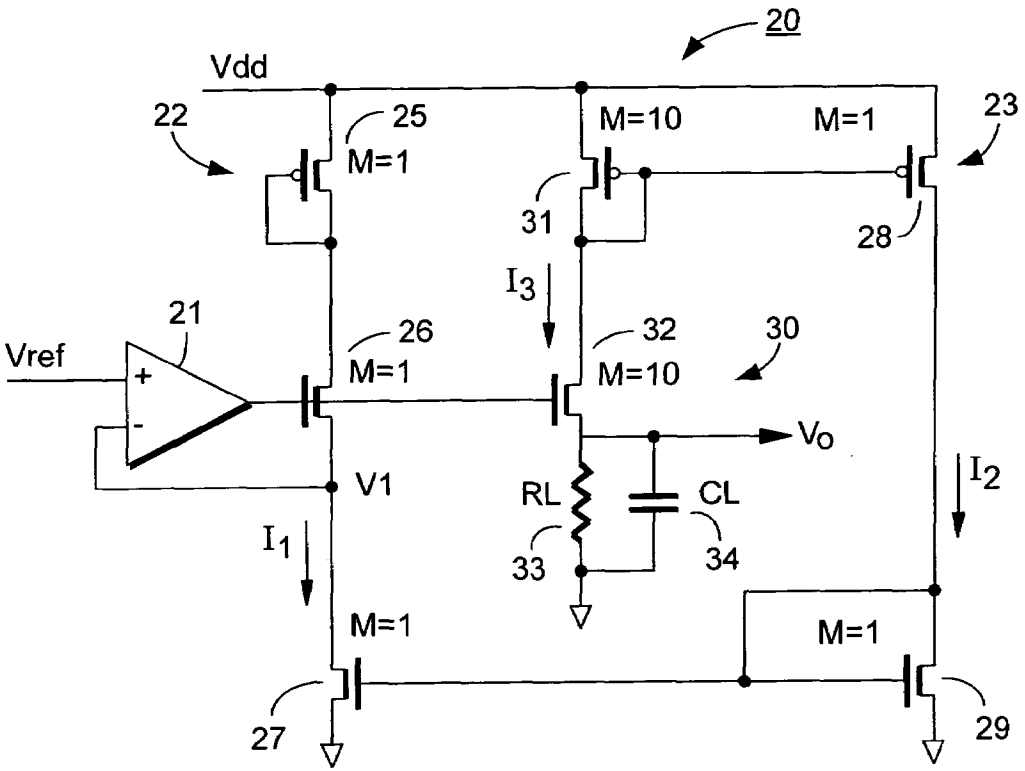
FIG. 2 is a circuit diagram showing an embodiment of a linear regulator according to the invention.
Figure 1:
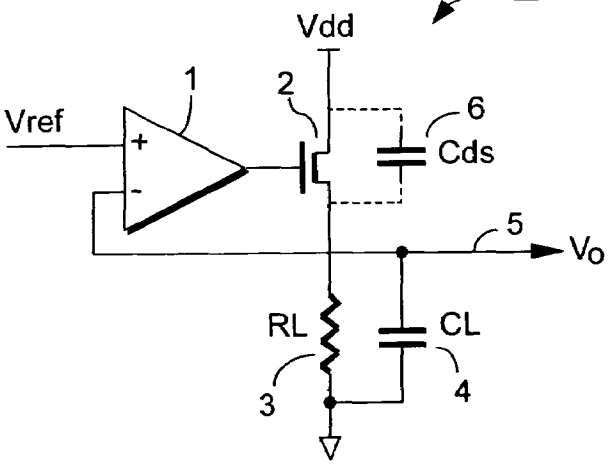
FIG. 1 (PRIOR ART)
FIG. 1 is a circuit diagram showing a simplified arrangement of a conventional linear regulator.

FIG. 2 is a circuit diagram showing an embodiment of a linear regulator according to the invention. As shown in FIG. 2, linear regulator 20 includes an op-amp 21 connected in a linear feedback loop to drive first current leg 22 and second current leg 23 based on a voltage reference Vref. First current leg 22 includes three transistors connected in series, namely, PMOS transistor 25, NMOS transistor 26, and NMOS transistor 27. Second current leg 23 includes two transistors connected in series, namely, PMOS transistor 28 and NMOS transistor 29.

Each of transistors 25, 26, 27, 28 and 29 have identical sizes. In FIG. 2, the sizes are shown at a normalized relative value of M=1, although it will be understood that these are normalized sizes and the actual sizes differ from a value of 1.

In operation, the linear feedback connection of op-amp 21 causes voltage V1 to be driven to the value of the reference voltage, namely, V1=Vref. In addition, because the sizes of all of the transistors in the first and second legs 22 and 23 are all equal, current I1 in the first leg is equal to current I2 in the second leg.

The linear regulator of this embodiment further includes an output driver 30 which includes PMOS transistor 31 connected in series with NMOS transistor 32 and a resistor-capacitor network composed of load resistance 33 (RL) and load capacitance (CL). The output voltage of the linear regulator is output across the CL load capacitor 34. The sizes of transistors 31 and 32 are chosen at a ratio of N times the sizes of the transistors in the first and second current legs 22 and 23. In this embodiment, the value of the ratio is N=10, but other values are also suitable for use in the invention. This is depicted in FIG. 2, where the sizes for transistors 31 and 32 are designated with normalized relative sizes of M=10.

The gate of PMOS transistor 31 is connected to the gate of PMOS transistor 28 in second current leg 23, and the gate of NMOS transistor 32 is connected to the output of op-amp 21, which also drives the gate of NMOS transistor 26 in first current leg 22. By virtue of these interconnections, the output driver 30 acts as a current mirror to the current I1 in first leg 22 and the current I2 in second current leg 23. However, because of the ratio of sizes, the current mirror is ratio-driven, such that current in the current mirror is N times the current I1 or I2. In this embodiment, since the relative sizes of the transistors in output driver 30 are 10 times those in first and second current legs 22 and 23, the value of the current I3 in the ratio-driven current mirror is $I3=10\times I1=10\times I2$.

In the FIG. 2 embodiment, the provision of the load capacitance 34 in the output driver results in the positioning of the load capacitor outside the linear feedback loop of op-amp 21. As a consequence, the load capacitance 34 can be chosen to a value as large as desired, according to the frequency rejection requirement, without undesirably destabilizing the feedback loop.

As previously indicated, the ability of a linear regulator to reject high frequencies in the power supply increases with an increase in the load capacitance. Thus, linear regulators according to the invention show remarkable improvement as compared with prior art linear regulators, in their ability to reject high frequency components of the power supply.

A preferred use for a linear regulator according to the invention is for the pre-amplifier chip of a hard disk drive. FIGS. 3A through 3G show other uses for a linear regulator according to the invention.

Figure 3B:
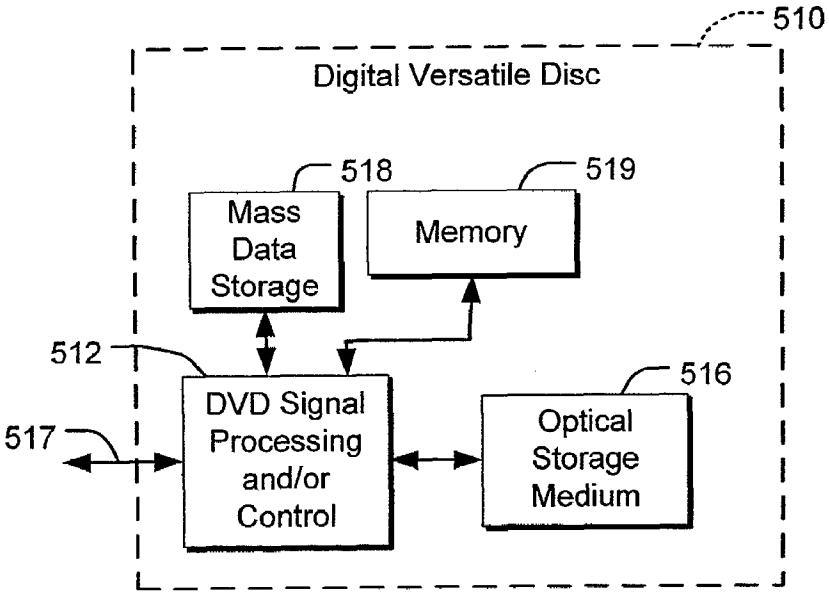
FIG. 3B is a block diagram of the invention in a DVD drive.
Figure 3A:
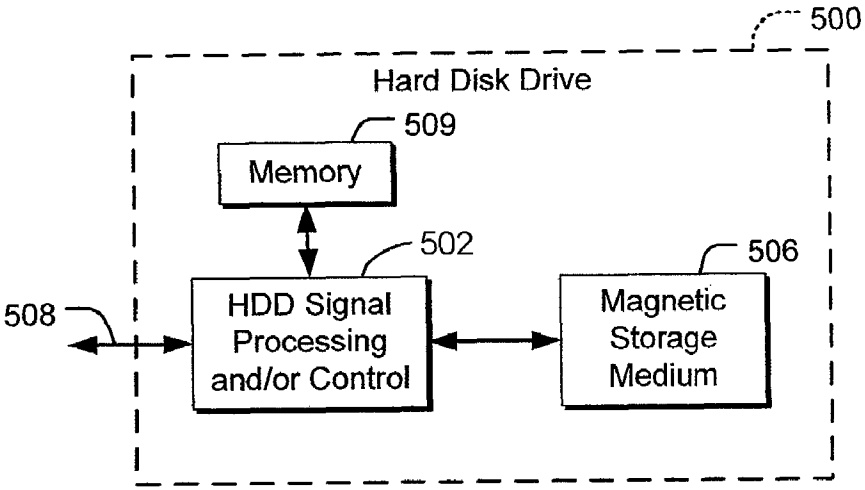
FIG. 3A is a block diagram showing an embodiment of the invention in a hard disk drive.

Referring now to FIGS. 3A-3G, various exemplary implementations of the present invention are shown. Referring to FIG. 3A, the present invention may be embodied as a linear regulator in a hard disk drive 500. The present invention may implement either or both signal processing and/or control circuits, which are generally identified in FIG. 3A at 502. In some implementations, signal processing and/or control circuit 502 and/or other circuits (not shown) in HDD 500 may process data, perform coding and/or encryption, perform calculations, and/or format data that is output to and/or received from a magnetic storage medium 506.

HDD 500 may communicate with a host device (not shown) such as a computer, mobile computing devices such as personal digital assistants, cellular phones, media or MP3 players and the like, and/or other devices via one or more wired or wireless communication links 508. HDD 500 may be connected to memory 509, such as random access memory (RAM), a low latency nonvolatile memory such as flash memory, read only memory (ROM) and/or other suitable electronic data storage.

Referring now to FIG. 3B, the present invention may be embodied as a linear regulator in a digital versatile disc (DVD) drive 510. The present invention may implement either or both signal processing and/or control circuits, which are generally identified in FIG. 3B at 512, and/or mass data storage 518 of DVD drive 510. Signal processing and/or control circuit 512 and/or other circuits (not shown) in DVD 510 may process data, perform coding and/or encryption, perform calculations, and/or format data that is read from and/or data written to an optical storage medium 516. In some implementations, signal processing and/or control circuit 512 and/or other circuits (not shown) in DVD 510 can also perform other functions such as encoding and/or decoding and/or any other signal processing functions associated with a DVD drive.

DVD drive 510 may communicate with an output device (not shown) such as a computer, television or other device via one or more wired or wireless communication links 517. DVD 510 may communicate with mass data storage 518 that stores data in a nonvolatile manner. Mass data storage 518 may include a hard disk drive (HDD) such as that shown in FIG. 3A. The HDD may be a mini HDD that includes one or more platters having a diameter that is smaller than approximately 1.8". DVD 510 may be connected to memory 519, such as RAM, ROM, low latency nonvolatile memory such as flash memory, and/or other suitable electronic data storage.

Figure 3D:
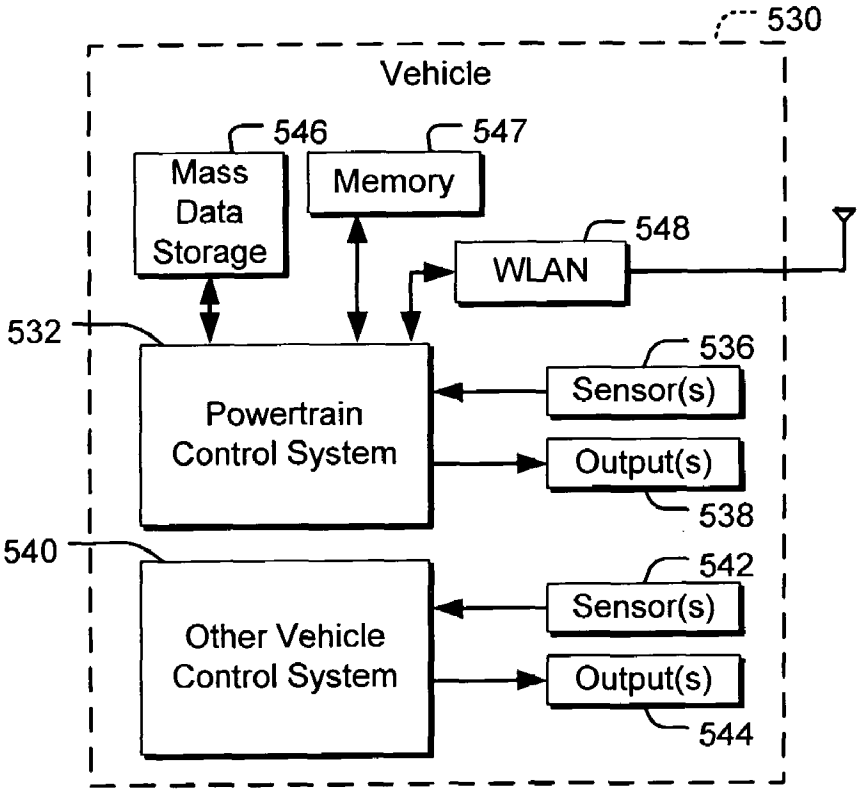
FIG. 3D is a block diagram of the invention in a vehicle control system.
Figure 3C:
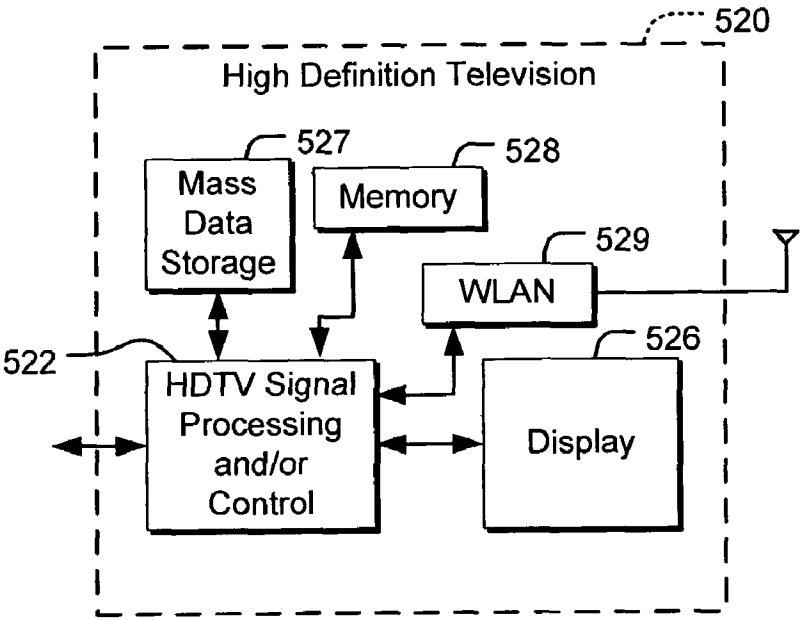
FIG. 3C is a block diagram of the invention in a high definition television (HDTV).

Referring now to FIG. 3C, the present invention may be embodied as a linear regulator in a high definition television (HDTV) 520. The present invention may implement either or both signal processing and/or control circuits, which are generally identified in FIG. 3C at 522, a WLAN interface and/or mass data storage of the HDTV 520. HDTV 520 receives HDTV input signals in either a wired or wireless format and generates HDTV output signals for a display 526. In some implementations, signal processing circuit and/or control circuit 522 and/or other circuits (not shown) of HDTV 520 may process data, perform coding and/or encryption, perform calculations, format data and/or perform any other type of HDTV processing that may be required.

HDTV 520 may communicate with mass data storage 527 that stores data in a nonvolatile manner such as optical and/or magnetic storage devices. At least one HDD may have the configuration shown in FIG. 3A and/or at least one DVD may have the configuration shown in FIG. 3B. The HDD may be a mini HDD that includes one or more platters having a diameter that is smaller than approximately 1.8". HDTV 520 may be connected to memory 528 such as RAM, ROM, low latency nonvolatile memory such as flash memory and/or other suitable electronic data storage. HDTV 520 also may support connections with a WLAN via a WLAN network interface 529.

Referring now to FIG. 3D, the present invention may be embodied as a linear regulator in a control system of a vehicle 530, a WLAN interface and/or mass data storage of the vehicle control system. In some implementations, the present invention implements a powertrain control system 532 that receives inputs from one or more sensors such as temperature sensors, pressure sensors, rotational sensors, airflow sensors and/or any other suitable sensors and/or that generates one or more output control signals such as engine operating parameters, transmission operating parameters, and/or other control signals.

The present invention may also be embodied in other control systems 540 of vehicle 530. Control system 540 may likewise receive signals from input sensors 542 and/or output control signals to one or more output devices 544. In some implementations, control system 540 may be part of an anti-lock braking system (ABS), a navigation system, a telematics system, a vehicle telematics system, a lane departure system, an adaptive cruise control system, a vehicle entertainment system such as a stereo, DVD, compact disc and the like. Still other implementations are contemplated.

Powertrain control system 532 may communicate with mass data storage 546 that stores data in a nonvolatile manner. Mass data storage 546 may include optical and/or magnetic storage devices for example hard disk drives HDD and/or DVDs. At least one HDD may have the configuration shown in FIG. 3A and/or at least one DVD may have the configuration shown in FIG. 3B. The HDD may be a mini HDD that includes one or more platters having a diameter that is smaller than approximately 1.8". Powertrain control system 532 may be connected to memory 547 such as RAM, ROM, low latency nonvolatile memory such as flash memory and/or other suitable electronic data storage. Powertrain control system 532 also may support connections with a WLAN via a WLAN network interface 548. The control system 540 may also include mass data storage, memory and/or a WLAN interface (all not shown).

Figure 3E:
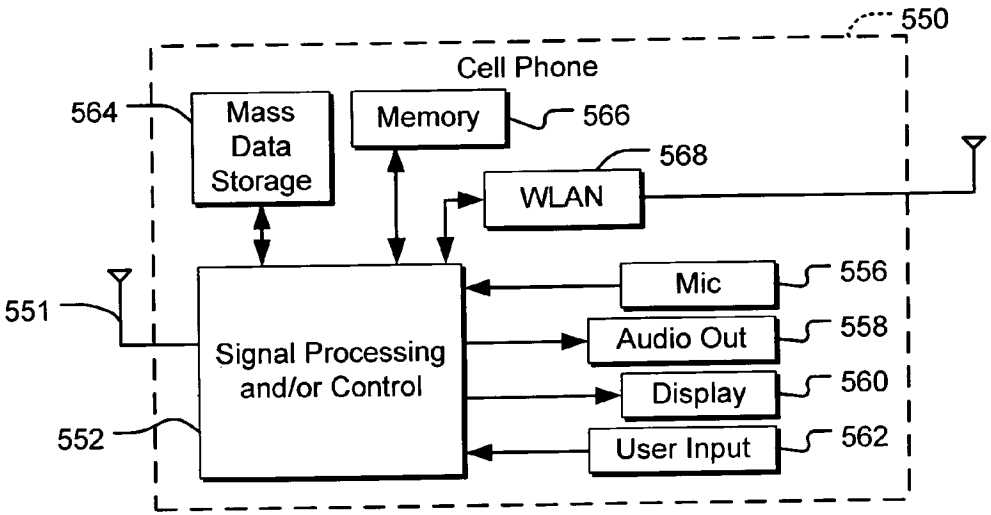
FIG. 3E is a block diagram of the invention in a cellular or mobile phone.

Referring now to FIG. 3E, the present invention may be embodied as a linear regulator in a cellular phone 550 that may include a cellular antenna 551. The present invention may implement either or both signal processing and/or control circuits, which are generally identified in FIG. 3E at 552, a WLAN interface and/or mass data storage of the cellular phone 550. In some implementations, cellular phone 550 includes a microphone 556, an audio output 558 such as a speaker and/or audio output jack, a display 560 and/or an input device 562 such as a keypad, pointing device, voice actuation and/or other input device. Signal processing and/or control circuits 552 and/or other circuits (not shown) in cellular phone 550 may process data, perform coding and/or encryption, perform calculations, format data and/or perform other cellular phone functions.

Cellular phone 550 may communicate with mass data storage 564 that stores data in a nonvolatile manner such as optical and/or magnetic storage devices for example hard disk drives HDD and/or DVDs. At least one HDD may have the configuration shown in FIG. 3A and/or at least one DVD may have the configuration shown in FIG. 3B. The HDD may be a mini HDD that includes one or more platters having a diameter that is smaller than approximately 1.8". Cellular phone 550 may be connected to memory 566 such as RAM, ROM, low latency nonvolatile memory such as flash memory and/or other suitable electronic data storage. Cellular phone 550 also may support connections with a WLAN via a WLAN network interface 568.

Figure 3F:
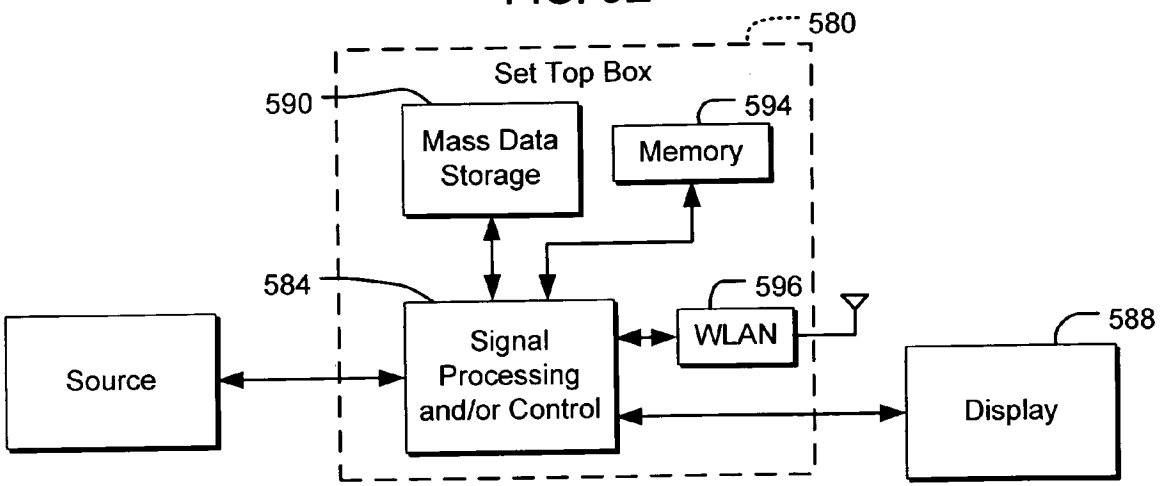
FIG. 3F is a block diagram of the invention in a set-top box (STB).

Referring now to FIG. 3F, the present invention may be embodied as a linear regulator in a set top box 580. The present invention may implement either or both signal processing and/or control circuits, which are generally identified in FIG. 3F at 584, a WLAN interface and/or mass data storage of the set top box 580. Set top box 580 receives signals from a source such as a broadband source and outputs standard and/or high definition audio/video signals suitable for a display 588 such as a television and/or monitor and/or other video and/or audio output devices. Signal processing and/or control circuits 584 and/or other circuits (not shown) of the set top box 580 may process data, perform coding and/or encryption, perform calculations, format data and/or perform any other set top box function.

Set top box 580 may communicate with mass data storage 590 that stores data in a nonvolatile manner. Mass data storage 590 may include optical and/or magnetic storage devices for example hard disk drives HDD and/or DVDs. At least one HDD may have the configuration shown in FIG. 3A and/or at least one DVD may have the configuration shown in FIG. 3B. The HDD may be a mini HDD that includes one or more platters having a diameter that is smaller than approximately 1.8". Set top box 580 may be connected to memory 594 such as RAM, ROM, low latency nonvolatile memory such as flash memory and/or other suitable electronic data storage. Set top box 580 also may support connections with a WLAN via a WLAN network interface 596.

Figure 3G:
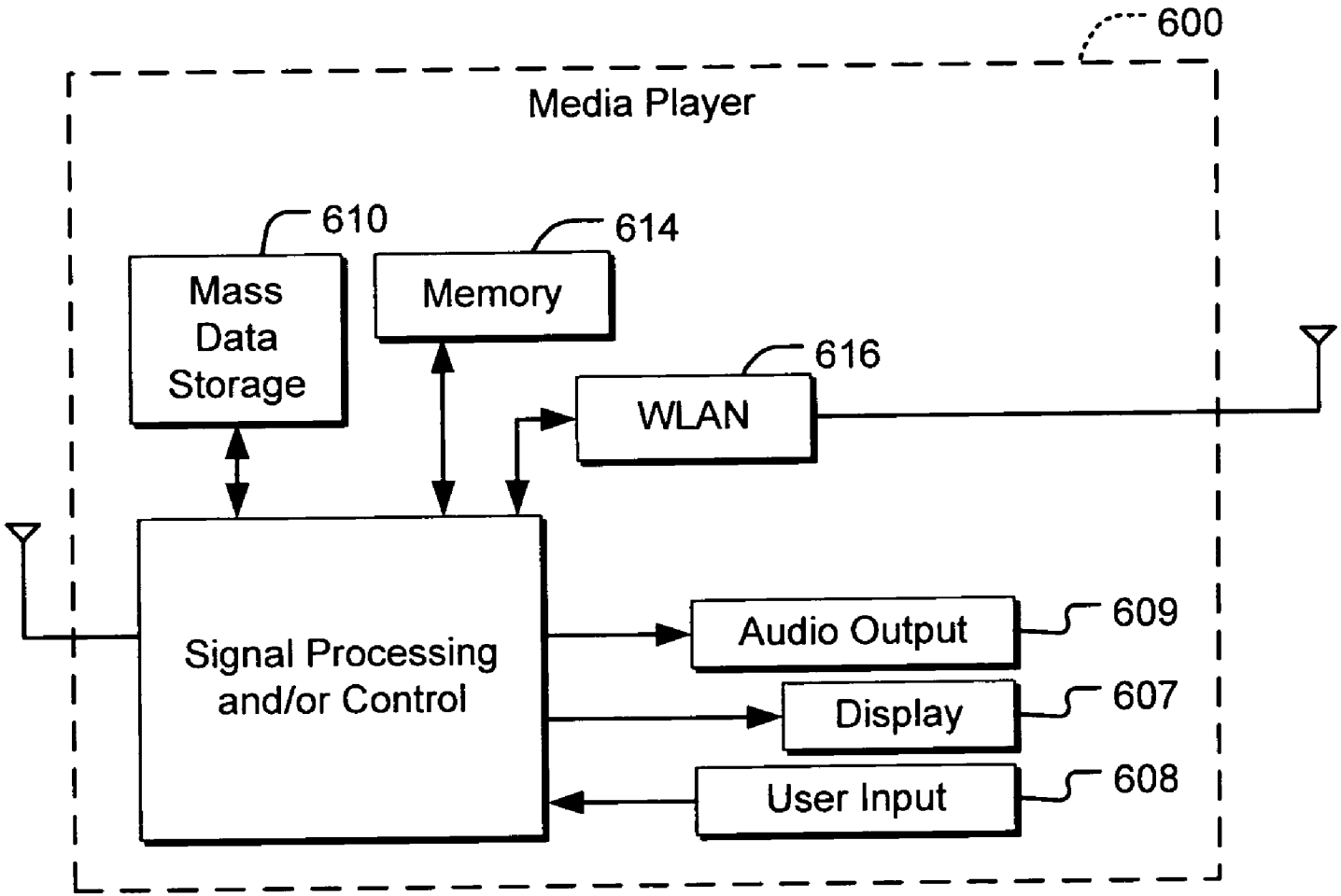
FIG. 3G is a block diagram of the invention in a media player.

Referring now to FIG. 3G, the present invention may be embodied as a linear regulator in a media player 600. The present invention may implement either or both signal processing and/or control circuits, which are generally identified in FIG. 3G at 604, a WLAN interface and/or mass data storage of the media player 600. In some implementations, media player 600 includes a display 607 and/or a user input 608 such as a keypad, touchpad and the like. In some implementations, media player 600 may employ a graphical user interface (GUI) that typically employs menus, drop down menus, icons and/or a point-and-click interface via display 607 and/or user input 608. Media player 600 further includes an audio output 609 such as a speaker and/or audio output jack. Signal processing and/or control circuits 604 and/or other circuits (not shown) of media player 600 may process data, perform coding and/or encryption, perform calculations, format data and/or perform any other media player function.

Media player 600 may communicate with mass data storage 610 that stores data such as compressed audio and/or video content in a nonvolatile manner. In some implementations, the compressed audio files include files that are compliant with MP3 format or other suitable compressed audio and/or video formats. The mass data storage may include optical and/or magnetic storage devices for example hard disk drives HDD and/or DVDs. At least one HDD may have the configuration shown in FIG. 3A and/or at least one DVD may have the configuration shown in FIG. 3B. The HDD may be a mini HDD that includes one or more platters having a diameter that is smaller than approximately 1.8". Media player 600 may be connected to memory 614 such as RAM, ROM, low latency nonvolatile memory such as flash memory and/or other suitable electronic data storage. Media player 600 also may support connections with a WLAN via a WLAN network interface 616. Still other implementations in addition to those described above are contemplated.

The invention has been described above with respect to particular illustrative embodiments. It is understood that the invention is not limited to the above-described embodiments and that various changes and modifications may be made by those skilled in the relevant art without departing from the spirit and scope of the invention.

What is claimed is:

1. A linear regulator for outputting a regulated voltage, comprising:

an op-amp connected in a linear feedback loop to drive first and second current legs based on a voltage reference, wherein each of said first and second current legs has active components with a first size;

an output driver including a load capacitance across which the regulated voltage is output;

wherein said output driver includes a ratio-driven current mirror having active components with a second size; and wherein said current mirror is driven to mirror current in said first and second current legs at a ratio of the first size to the second size.

2. A linear regulator according to claim 1, wherein said first current leg includes at least three series-connected transistors including a first transistor whose gate is driven by an output of said op-amp, wherein sizes of said three series-connected transistors are equal to the first size; and wherein said second current leg includes at least two series-connected transistors, wherein sizes of said two series-connected transistors are also equal to the first size.

3. A linear regulator according to claim 2, wherein said output driver includes at least two series-connected transistors including a second transistor whose gate is driven by the output of said op-amp, wherein sizes of said two series-connected transistors are equal to the second size.

4. A linear regulator according to claim 3, wherein said load capacitance is connected in series with said two series-connected transistors of said output driver.

5. A linear regulator according to claim 4, further comprising a load resistance connected in a resistor-capacitor network with said load capacitance and further connected in series with said two series-connected transistors of said output driver.

6. A linear regulator according to claim 1, wherein said reference voltage is provided by a bandgap reference and wherein said output voltage is provided to a preamplifier of a hard disk drive.

7. A linear regulator for outputting a regulated voltage, comprising:

op-amp means connected in a linear feedback loop to drive first and second current leg means based on a voltage reference, wherein each of said first and second current leg means each has active components with a first size;

output driver means including a load capacitance across which the regulated voltage is output;

wherein said output driver means includes ratio-driven current mirror means having active components with a second size; and wherein said current mirror means is driven to mirror current in said first and second current leg means at a ratio of the first size to the second size.

8. A linear regulator according to claim 7, wherein said first current leg means includes at least three series-connected transistors including a first transistor whose gate is driven by an output of said op-amp means, wherein sizes of said three series-connected transistors are equal to the first size; and wherein said second current leg means includes at least two series-connected transistors, wherein sizes of said two series-connected transistors are also equal to the first size.

9. A linear regulator according to claim 8, wherein said output driver means includes at least two series-connected transistors including a second transistor whose gate is driven by the output of said op-amp means, wherein sizes of said two series-connected transistors are equal to the second size.

10. A linear regulator according to claim 9, wherein said load capacitance is connected in series with said two series-connected transistors of said output driver means.

11. A linear regulator according to claim 10, further comprising a load resistance connected in a resistor-capacitor network with said load capacitance and further connected in series with said two series-connected transistors of said output driver means.

12. A linear regulator according to claim 7, wherein said reference voltage is provided by bandgap reference means and wherein said output voltage is provided to pre-amplifier means of a hard disk drive.

13. A method for outputting a regulated voltage comprising:

providing an op-amp connected in a linear feedback loop to drive first and second current legs based on a voltage reference, wherein said each of first and second current legs has active components with a first size;

providing an output driver including a load capacitance across which the regulated voltage is output, wherein said output driver includes a ratio-driven current mirror having active components with a second size; and driving said current mirror so as to mirror current in said first and second current legs at a ratio of the first size to the second size.

14. A method according to claim 13, wherein said first current leg includes at least three series-connected transistors including a first transistor whose gate is driven by an output of said op-amp, wherein sizes of said three series-connected transistors are equal to the first size; and wherein said second current leg includes at least two series-connected transistors, wherein sizes of said two series-connected transistors are also equal to the first size.

15. A method according to claim 14, wherein said output driver includes at least two series-connected transistors including a second transistor whose gate is driven by the output of said op-amp, wherein sizes of said two series-connected transistors are equal to the second size.

16. A method according to claim 15, wherein said load capacitance is connected in series with said two series-connected transistors of said output driver.

17. A method according to claim 16, further comprising a load resistance connected in a resistor-capacitor network with said load capacitance and further connected in series with said two series-connected transistors of said output driver.

18. A method according to claim 13, wherein said reference voltage is provided by a bandgap reference and wherein said output voltage is provided to a preamplifier of a hard disk drive.

* * * * *